United States Patent [19]

Ungarean et al.

[11] 4,452,297

[45] Jun. 5, 1984

[54] PROCESS AND APPARATUS FOR SELECTING THE DRIVE FREQUENCIES FOR INDIVIDUAL ELECTROMAGNETIC CONTAINMENT INDUCTORS

[75] Inventors: Gary L. Ungarean, Woodbridge; John C. Yarwood, Madison; Peter J. Kindlmann, Guilford; Derek E. Tyler, Cheshire, all of Conn.

[73] Assignee: Olin Corporation, New Haven, Conn.

[21] Appl. No.: 355,036

[22] Filed: Mar. 5, 1982

[51] Int. Cl.[3] ..... B22D 11/00; B22D 27/02

[52] U.S. Cl. ..... 164/467; 164/503

[58] Field of Search ..... 164/147.1, 467, 498, 164/503, 505

[56] References Cited

U.S. PATENT DOCUMENTS

| | | | |
|---|---|---|---|
| 3,467,166 | 9/1969 | Getselev et al. | 164/467 |
| 3,702,155 | 11/1972 | Getselev | 164/467 |
| 3,985,179 | 10/1976 | Goodrich et al. | 164/467 |
| 4,014,379 | 3/1977 | Getselev | 164/467 |
| 4,161,206 | 7/1979 | Yarwood et al. | 164/467 |

*Primary Examiner*—Gus T. Hampilos
*Assistant Examiner*—Jerold L. Johnson
*Attorney, Agent, or Firm*—Howard M. Cohn; Paul Weinstein; Barry L. Kelmachter

[57] ABSTRACT

A multi-strand process is provided for casting molten materials into ingots of desired shape. The process uses two inductors for receiving the molten material and applying the first and second electromagnetic force fields to form the molten material into the ingots. The inductors are located adjacent each other so that the first and second force fields interact with each other. A first device is associated with one of the inductors for applying a first alternating current at a first desired frequency to an associated inductor to generate the first magnetic force field. A second device is associated with the other of the inductors for applying a second alternating current at a second desired frequency to generate the second magnetic force field. The second frequency is set to a desired value in relation to the first frequency in order to control the first and second resulting containment currents circulating in the molten material. The containment currents are due to the first and second force fields and their interaction with each other. The containment currents each have a frequency above a lower established limit so as to prevent formation of substantial melt stirring and containment instabilities in either of the first or second inductors.

7 Claims, 4 Drawing Figures

PROCESS AND APPARATUS FOR SELECTING THE DRIVE FREQUENCIES FOR INDIVIDUAL ELECTROMAGNETIC CONTAINMENT INDUCTORS

While the invention is subject to a wide range of applications, it is especially suited for use in the electromagnetic forming of a plurality of castings and will be particularly described in that connection. The process and apparatus provide for the selection of the drive frequencies for individual electromagnetic containment inductors so as to minimize the interaction between adjacent inductors in a multi-strand casting operation.

The electromagnetic casting apparatus comprises a three-part mold consisting of an inductor, a nonmagnetic screen, and a manifold for applying cooling water to the ingot. Such an apparatus is exemplified in U.S. Pat. No. 3,467,166 to Getselev et al. Containment of molten material, such as metal, in electromagnetic casting is achieved without direct contact between the molten metal and any component of the mold. The molten metal head is contained by a magnetic force. The magnetic force results from the passage of an alternating current through an inductor surrounding the molten metal head. Accordingly, control of the containment process involves control of the molten metal head and/or control of the alternating current amplitude. Without such control, ingots or castings of variable cross sections and surface quality result as successive equilibria between the magnetic force and the molten metal head are established.

Control of the metal head may be achieved by a variety of techniques known in the art. U.S. patent application Ser. No. 110,893, now abandoned, filed by Ungarean et al. entitled "Electromagnetic Casting Process and Apparatus" discloses, for example, that "the magnetic field defines a containment zone for the molten metal. The hydrostatic pressure exerted by the molten metal in the containment zone is sensed and in response thereto the flow of molten metal into the containment zone is controlled. This minimizes changes in the hydrostatic pressure."

Techniques for control of inductor current to effect molten head are also known in the art. U.S. Pat. No. 4,014,379 to Getselev discloses, for example, an electromagnetic casting system wherein "the molten metal is actuated by an electromagnetic field of an inductor, in which case the current flowing through the inductor is controlled depending on the deviations of the dimensions of the liquid zone of the ingot from a prescribed value, and thereafter, the molten metal is cooled down." Also, in U.S. Pat. No. 4,161,206 to Yarwood et al., an electromagnetic casting apparatus and process is provided wherein, for example, a "control system is utilized to minimize variations in the gap between the molten metal and an inductor which applies the magnetic field. The gap or an electrical parameter related thereto is sensed and used to control the current to the inductor."

Control of the electromagnetic process by regulation of liquid metal head at constant inductor current or voltage requires very tight control of the head, i.e. ±0.1 mm. Such control is feasible in low speed casting of large aluminum ingots, but is very difficult to achieve at moderate or high casting speeds with relatively small cross sections. Accordingly, in electromagnetic casting of copper alloys, control of inductor current is the preferred technique of regulating the height of the molten head. In this latter technique, the head level must be controlled, but larger variation, i.e. ±10 mm can be tolerated.

The above description refers to casting of one ingot (or strand) at a time. Where multi-strand casting is undertaken, control of every strand must be maintained. The prior art discloses multi-strand inductor arrangements and configurations as shown in U.S. Pat. No. 3,702,155 to Getselev, using one power supply with parallel or series connected inductors. If the inductors are connected in series to one power supply as suggested, the same current is established in each inductor. The current depends on the supply voltage and the average conditions extant in the strands controlling their total reactance and exact control of each strand is difficult to achieve. On the other hand, if a simple parallel connection is used, the same voltage is applied to each inductor, again independent of the extant conditions in a particular electromagnetic casting strand. In this latter case, individual inductor currents change as the reactance of its particular strand changes. Accordingly, independent control over voltage as required by the control systems in both U.S. Pat. Nos. 4,014,379 and 4,161,206 is not possible.

U.S. patent application Ser. No. 236,386, now abandoned, filed by Yarwood et al. discloses an electromagnetic casting system for forming a plurality of castings having individual head control of the castings. The inductors are preferably connected in series to one power supply and the current distribution is modified in each inductor to minimize variations in the gap between the inductor and the surface of the molten material.

U.S. patent application Ser. No. 317,373, filed by Kindlmann et al. discloses electromagnetic casting of a plurality of castings wherein "the process and apparatus provide for the individual head control of the molten castings with substantial elimination of beat frequency interface".

Another control scheme is to control all of the molten heads in concert in a plurality of strands. This will allow the use of either voltage or inductance control. Further, a fixed uniform head in all of the strands will allow the use of a simple fixed voltage supply. However, as indicated above and detailed in U.S. Pat. Nos. 4,014,379 and 4,161,206, such control of head is not readily attainable. This is particularly the case with heavier melting metals cast in smaller sections at moderate to high speed. A solution to the control problem is to use separate power supplies or inverters for each strand so that the control means suggested in U.S. Pat. Nos. 4,014,379 and 4,161,206 may be used separately on each strand. In this case, beat frequencies generated by interacting inductors may detract from the containment control within each by pumping of metal or large scale stirring effects. For this reason, a low frequency limit of 500 Hz is normally associated with the electromagnetic casting process as indicated by Goodrich in U.S. Pat. No. 3,985,179. Of course, the actual low frequency limit is dependent on the section being cast and its electrical properties. Thus, in the electromagnetic casting of thin strip silicon, a much higher low frequency limit in the order of many kilohertz will be established.

The electro to mechanical force transduction involved in electromagnetic containment introduces a quadratic type modulation of the containment pressure. In addition, the non-linear elements in the electrical network of the electromagnetic casting system generate a cubic modulation process. Both modulation processes must be taken into account where multi-inductor systems are fed by separate power supplies. There is a possibility that modulation between the different inductor drive frequencies can occur. In the event that the interaction between the plurality of inductors generates low frequency signals within the containment power circuit, adverse melt stirring and general containment instabilities may be created.

It is a problem underlying the present invention to prevent the interaction between inductors of a multi-strand electromagnetic casting system from detracting from the containment control within each of the strands.

It is an advantage of the present invention to provide a multi-strand apparatus for casting molten materials into a plurality of ingots of desired shape which obviates one or more of the limitations or disadvantages of the described prior arrangements.

It is a further advantage of the present invention to provide a multi-strand apparatus for casting molten materials into a plurality of ingots wherein the containment current circulating in the shaped molten material is maintained above a established low frequency.

It is a further advantage of the present invention to provide a multi-strand apparatus for casting molten materials into a plurality of ingots wherein the formation of substantial adverse melt stirring and containment instabilities in either of the inductors is minimized.

Accordingly, there has been provided a multi-strand apparatus and process for casting molten materials into ingots of desired shape. The apparatus comprises two inductors for receiving the molten material and applying the first and second electromagnetic force fields to form the molten material into the ingots. The inductors are located adjacent each other so that the first and second force fields interact with each other. A first device is associated with one of the inductors for applying a first alternating current at a first desired frequency to an associated inductor to generate the first magnetic force field. A second device is associated with the other of the inductors for applying a second alternating current at a second desired frequency to generate the second magnetic force field. The second frequency is set to a desired value in relation to the first frequency in order to control the first and second resulting containment currents circulating in the molten material. The containment currents are due to the first and second force fields and their interaction with each other. The containment currents each have a frequency above a lower established limit so as to prevent formation of substantial adverse melt stirring and containment instabilities in either of the first or second inductors.

The invention and further developments are now elucidated by means of preferred embodiments shown in the drawings.

A multi-strand apparatus 10 is provided for casting molten materials into ingots of desired shape. The apparatus 10 comprises two inductors 12, 12' for receiving the molten material and applying first and second electromagnetic force fields to form the molten material into the ingots C, C'. The inductors are located adjacent each other whereby the first and second force fields interact with each other. A device 16 is associated with one of the inductors 12 for applying a first alternating current at a first desired frequency to its associated inductor to generate the first magnetic force field. A second device 16' is associated with the other of the inductors 12' for applying a second alternating current at a second desired frequency to generate the second magnetic force field. The second frequency has a desired value in relation to the first frequency in order for the first and second resulting containment currents circulating in the molten material within the first and second inductors, due to the first and second force fields and their interaction with each other, to each have a frequency above a lower established limit so as to prevent the formation of substantial adverse melt stirring and containment instabilities in either of the first or second inductors.

Figure 1:
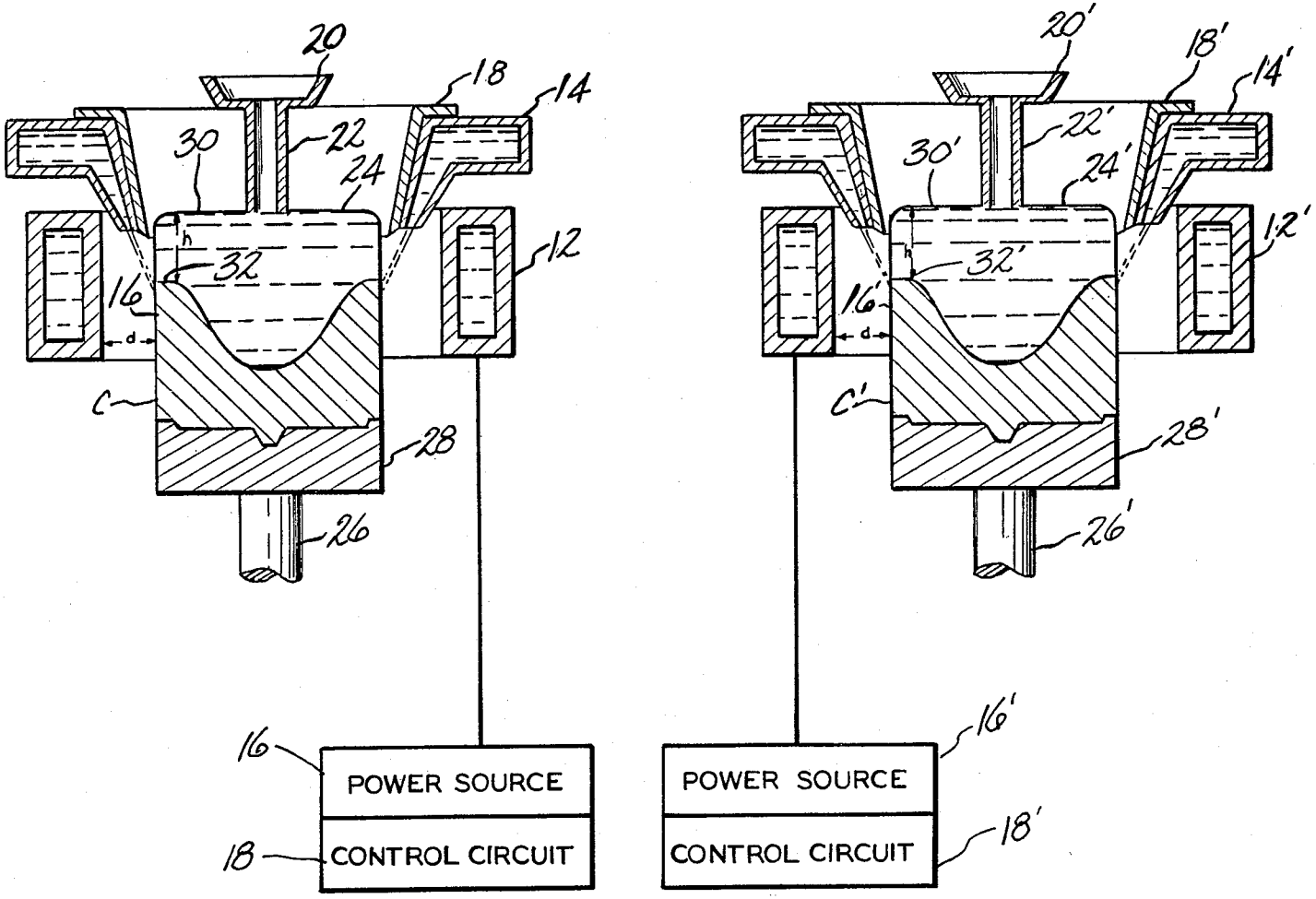
FIG. 1 is a schematic representation of an electromagnetic casting apparatus in accordance with the present invention.

Referring now to FIG. 1, there is shown by way of example an electromagnetic casting apparatus of this invention having two casting strands. Since the elements of each casting device may be substantially identical, prime numbers are used to indicate like elements. Further, only one of the molds is described in general since they both operate in the same manner.

The electromagnetic casting mold is comprised of inductor 12 which is water cooled; a cooling manifold 14 which applies cooling water to the peripheral surface of the molten material such as metal being cast C; and a non-magnetic screen 18. Molten metal is continuously introduced into the mold during a casting run using a trough 20, downspout 22 and molten metal gap control in accordance with this invention. The inductor 12 is excited by an alternating current from a power source 16. This alternating current in the inductor 12 produces a magnetic field which interacts with the molten metal head 24 to produce eddy currents therein. These eddy currents in turn interact with the magnetic field and produce forces which apply a magnetic pressure to the molten metal head to contain it in the zones defined by the magnetic field so that it solidifies into an ingot C having a desired cross section.

An air gap "d" exists during casting, between the molten metal head 24 and the inductor 12. The molten metal head is formed or molded into the same general shape as the corresponding inductor thereby providing the desired ingot cross section. The inductor may have any desired geometrical shape including circular or rectangular as required to obtain the desired cross section of ingot C.

The purpose of the non-magnetic screen 18 is to fine tune and balance the magnetic pressure with the hydrostatic pressure of the molten metal head. The non-magnetic screen may comprise a separate element as shown or may, if desired, be incorporated as a unitary part of the manifold for applying the coolant.

Initially, a conventional ram 26 and bottom block 28 are held in the magnetic containment zone of the mold to allow the molten metal to be poured into the mold at the start of the casting run. The ram and bottom block are then uniformly withdrawn at a desired casting rate.

Solidification of the molten metal, which is magnetically contained in the mold, is achieved by direct application of water from the cooling manifold 14 to the ingot surface. In the embodiment shown in FIG. 1, the water is applied to the ingot surface within the confines of the inductor 12. The water may be applied to the ingot surface above, within or below the related inductor as desired.

If desired, any of the prior art mold constructions or other known arrangements of the electromagnetic casting apparatus as described in the background of the invention could be employed for either one or all of the plurality of casting apparatuses used in accordance with the invention.

The present invention is concerned with the control of a multi-strand electromagnetic casting process and apparatus in order to provide cast ingots C which have a substantially uniform cross section over the length of the ingot and which are formed of materials such as metals, alloys, metalloids, semiconductors, etc. This may be accomplished in accordance with the present invention by sensing the electrical properties of the individual inductors which are a function of the gap "d" between the inductor and the load. The load consists of the molten material head corresponding to the pool of molten metal arranged above the solidifying ingot C which exerts the aforenoted hydrostatic pressure in the magnetic containment zone. In a typical vertical casting apparatus as shown in FIG. 1, the molten metal head 24 extends from the top surface 30 of the molten metal pool to the solid-liquid interface or solidification front 32, as indicated by "h", and further includes a limited contribution associated with the molten material in and above the downspout 22. The electrical property of the casting apparatus, which is a function of the gap between the molten metal head 24 and the interior surface of the inductor 12, is sensed by control circuit 34 and a gap signal representative thereof is generated. Responsive to the gap signal, the current delivery to the inductor is controlled so as to maintain the gap substantially constant.

The electro to mechanical force transduction involved in electromagnetic containment introduces a quadratic type modulation of the containment pressure. In addition, the non-linear elements in the electrical network of the electromagnetic containment system generate a cubic modulation process. Both modulation processes must be taken into account where multi-inductor systems fed by separate power supplies are considered. It is the purpose of this invention to teach how to avoid such interaction problems in multi-strand electromagnetic casting.

The electromagnetic pressure exerted on an ingot during electromagnetic casting is proportional to the square of the current within the load. Because of the quadratic nature of the electro to mechanical force transduction, modulating containment pressures can be created without having containment currents flowing in the system at the frequency of the modulation. That is the containment pressure, P, is proportional to the square of the containment current, I, circulating in the load, $P\alpha I^2$. Then, I may consist of the primary alternating current $I_1$ operating at frequency $F_1$ and an interference current $I_n$ at frequency $F_n$ due to an adjacent inductor, $I=I_1+I_n$. The total pressure exerted on the ingot is then proportional to $I^2$ which is $(I_1+I_n)^2$.

$$P\alpha I^2=(I_1+I_n)^2$$

For the simplest case $I_1$ and $I_n$ are sine waves where $$I_1=I_1 \sin F_1 t \text{ and } I_n=I_n \sin F_n t$$

By substituting into the equation for the containment pressure, $$P\alpha(I_1 \sin F_1 t+I_n \sin F_n t)^2$$

Expanding and reducing the equation indicates a low frequency containment pressure component which vibrates at a frequency that is the difference of the two main frequencies, $F_1$31 $F_n$. For example, if $F_1$ and $F_n$ are 3000 Hz and 2990 Hz, respectively, then the low frequency pulsating pressure will be at 10 Hz (3000−2990). The amplitude of the low frequency current will be a function of the flux coupling between the two inductors which may typically vary between ½ and 25 percent of the flux produced by inductor in which the low frequency current is being considered.

Figure 2:
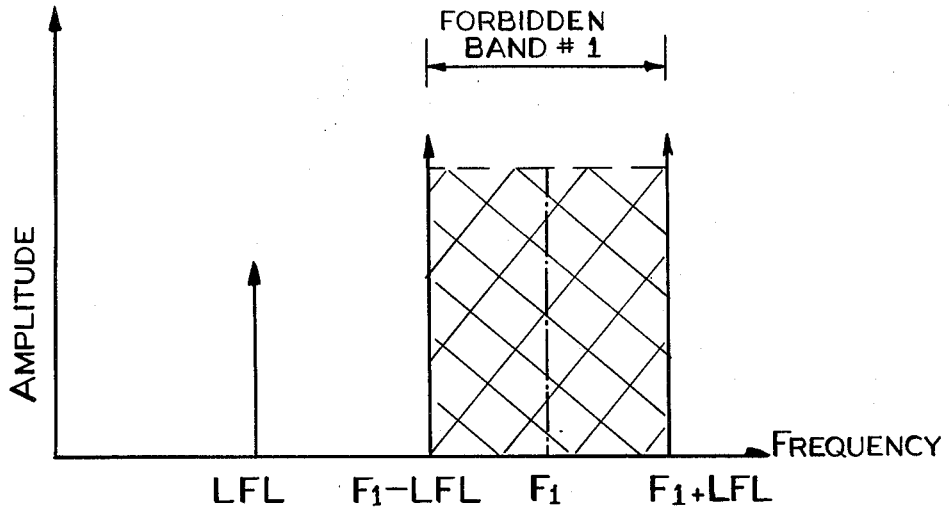
FIG. 2 is a diagram indicating the operating spectrum for adjacent inductors due to quadratic electro to mechanical pressure transformation.

Thus, for example, if a low frequency limit of 750 Hz is established for the containment process, then adjacent inductors must have a frequency spacing of 750 Hz or more so that the low frequency "quadratic modulation pressure" exerted on the ingot is above the lower limit cut off point as illustrated in FIG. 2.

Specifically, $F_2$ (the frequency of the alternating current in an adjacent inductor) must have a value greater than the lowest frequency limit (LFL) and out of the forbidden band represented by the spacing between $F_1-LFL$.

$$LFL \leqq F_2 \leqq F_1-LFL$$

The forbidden band width, as seen in FIG. 2, is equal to twice the LFL. Further, $F_2$ may have a value greater or equal to $F_1+LFL$.

$$F_2 \geqq F_1+LFL$$

If two signals are present simultaneously in an electric circuit, the composite signal or signals generated are a function of the elements of the electric circuit. Electric circuits can be classed as either linear or non-linear. If the circuit is linear, then superposition holds. That is, if the inductor voltage V is comprised of a signal $V_s$ and a noise component $V_n$ (representing any pickup especially from adjacent inductors), then the current that would flow in the circuit due to each voltage signal (with the other being zero) is $I_s$ and $I_n$, respectively:

$$I_s=V_s/Z \text{ with } V_n=0 \text{ (Signal)}$$

$$I_n=V_n/Z \text{ with } V_s=0 \text{ (Noise)}$$

Then, with the superposition of both applied voltage signals, $V_s+V_n$, the response of the network is the sum of $I_s$ and $I_n$ $$\frac{V}{Z}=\frac{V_s+V_n}{Z}=I_s+I_n$$

where Z is the complex impedance of the circuit. However, if the circuit is non-linear, then superposition does not hold.

$$\frac{V}{Z} = \frac{V_s + V_n}{Z} \neq I_s + I_n$$

For a circuit to be non-linear, its complex impedance z must be non-linear. In a typical electromagnetic casting network, this can happen if the power system contains such non-linear devices as iron core transformers, SCR's and MG sets.

Due to the predominantly odd symmetry of the above electrical devices in the network, the applied voltage signals combine according to a cubic law, PS $$V=(V_1+V_2)^3$$

The amount of distortion or modulation generated basically depends upon the quantity of flux coupling from one inductor to another and the degree of nonlinearity contained within each circuit. This distortion exists at frequencies $F_1 \pm 2F_1$, $F_2 \pm 2F_1$, $F_1 \pm 2F_2$, $F_2 \pm 2F_2$ and $F_2$ for two sinusoidal current drives of frequency $F_1$ and $F_2$, respectively.

If two inductors are driven with sinusoidal current generators at frequencies of 2100 Hz and 4000 Hz, then the harmonics generated will occur at frequencies 2100 Hz, 6300 Hz, 200 Hz, 8200 Hz, 5900 Hz, 10,100 Hz, 4000 Hz and 12,000 Hz. As can be seen, it is possible to generate low frequency signals, i.e. 200 Hz, within the containment power circuit which could lead to adverse melt stirring and general containment instabilities. Additionally, if the containment power generated for each process contains harmonics and if higher harmonics are of concern, then these must be included in the cubic modulation process. For two signals, $F_{11}$ and $F_{21}$, and their respective third harmonics, $F_{13}$ and $F_{23}$, the modulation would be:

$$F\alpha(F_{11}+F_{13}+F_{21}+F_{23})^3$$

The lowest frequency that can be generated through this process is dependent on the frequency separation of the two fundamental drive signals which is proportional to $F_2-2F_1$ where $F_1$ is the frequency of the primary drive and $F_2$ is the frequency of an adjacent inductor. Assuming as above that the lowest frequency level which can be tolerated within the process is known or empirically established, then this frequency must be set to be greater than or equal to the lowest frequency level.

$$F_2-2F_1 \geqq LFL$$

$$F_2 \geqq LFL+2F_1$$

Further, this frequency may also be less than or equal to the negative component of the lowest frequency level.

$$F_2-2F_1 \leqq -LFL$$

$$F_2 \leqq 2F_1-LFL$$

Then, the allowable frequencies at which adjacent inductor drives may operate are $$2F_1-LFL \geqq F_2 \geqq LFL+2F_1$$

Figure 3:
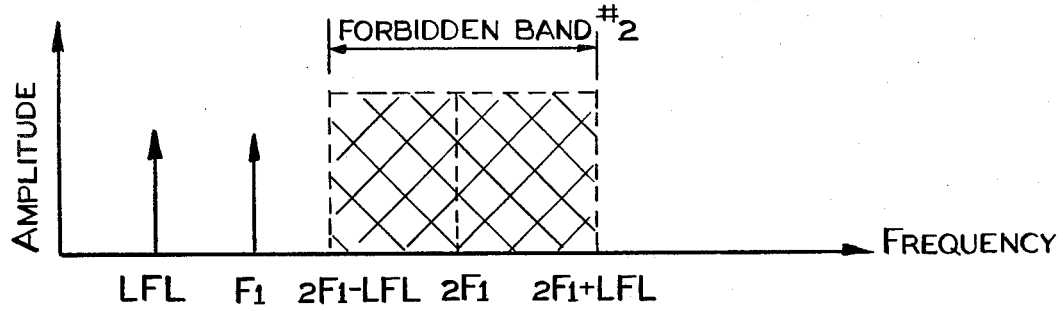
FIG. 3 is a diagram of the allowable operating spectrum for adjacent inductors due to cubic law modulation.

Selection of the lower frequency limit creates a forbidden band of operating frequencies for adjacent inductors. The center of the band is at $2F_1$ and has a band width equal to twice the lower frequency limit as shown in FIG. 3.

For example, if the lower frequency limit is again 750 Hz and one inductor is selected to operate at 3000 Hz, then the forbidden band of frequencies established by the "cubic modulation process" for an adjacent inductor is between 5250 Hz and 6750 Hz. That is, the adjacent inductor may operate at any frequency between 750 Hz and 5250 Hz or above 6750 Hz.

Figure 4:
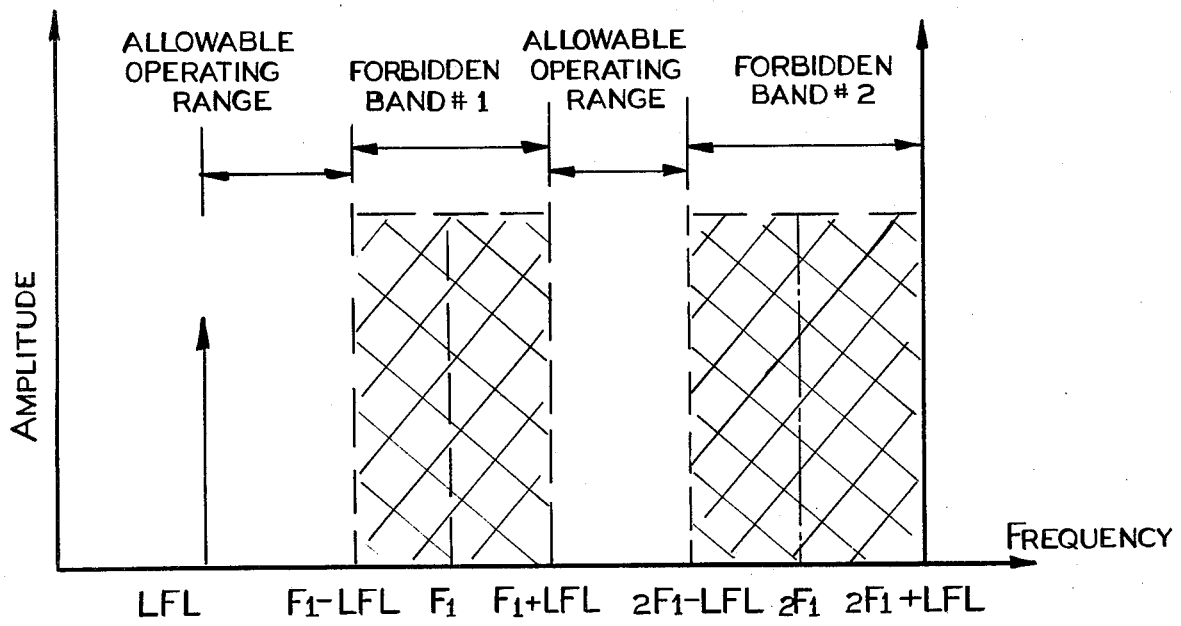
FIG. 4 is a diagram of the composite operating spectrum due to quadratic and cubic law modulation.

The containment noise generated through both the quadratic and cubic modulation process must be considered when selecting operating frequencies for adjacent inductors. Such an operating spectrum is illustrated in FIG. 4. As indicated above, it is normal practice to limit frequencies in electromagnetic casting of metal to above 500 Hz. Accordingly, if 750 Hz is the actual critical lower limit for a given system, then the following example illustrates the restrictions imposed on power supply selection for a two strand electromagnetic casting station. If the first power supply is chosen to be 3000 Hz, then the available operating windows for the second power supply according to FIG. 4 are 750 to 2250 Hz, 3750 to 5250 Hz and above 6750 Hz. However, selection of a second 3 kHz supply would be inappropriate and would result in considerable control problems. This is due to the difficulty in maintaining the frequency at the exact value. A slight deviation would lead to the formation of a low frequency signal.

The basic concept taught in this specification could be used and applied to a system with three or more strands. However, the analysis is onerous and difficult. Accordingly, for simplicity and clarity, it is not detailed herein.

It is apparent that there has been provided in accordance with this invention a multi-strand electromagnetic casting apparatus and method which fully satisfies the objects, means, and advantages set forth hereinabove. While the invention has been described in combination with the specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A process for casting molten material into ingots of desired shape comprising the following steps:

providing two inductors for separately receiving said molten material and applying first and second electromagnetic force fields to form the molten material into said ingots;

locating said inductors adjacent each other whereby said first and second force fields interact with each other;

applying a first alternating current at a first desired frequency to one of said inductors to generate the first magnetic force field;

applying a second alternating current at a second desired frequency to generate the second magnetic force field;

selecting said second frequency in relation to said first frequency in order for first and second resulting containment currents within the first and second inductors to have all their generated frequency components above a desired low frequency limit (LFL) of about 500 Hz so as to prevent substantial melt stirring and containment instabilities in either of said first or second inductors;

selecting the second desired frequency out of the range between $F_1 \pm LFL$ where $F_1$ is the first desired frequency.

2. A process as in claim 1 further including the step of selecting the second desired frequency out of the range between $2F_1 \pm LFL$ to prevent the generation of frequencies that cause containment instabilities.

3. A process as in claim 2 including the step of selecting said first and second frequencies to each be above about 500 Hz.

4. A process as in claim 3 including the step of selecting said first and second frequencies to each be above about 750 Hz.

5. A process as in claim 3 including the step of selecting said second frequency so that each of said at least one generated frequency component has a low frequency limit (LFL) of about 500 Hz.

6. A process as in claim 5 including the step of selecting said select frequency so that each of said at least one generated frequency component has a low frequency limit (LFL) of about 750 Hz.

7. A process as in claim 6 further including the step of providing non-linear first and second alternating currents.

* * * * *